US008475293B2

(12) United States Patent
Morin et al.

(10) Patent No.: US 8,475,293 B2
(45) Date of Patent: Jul. 2, 2013

(54) IRON GOLF CLUB HEAD WITH IMPROVED PERFORMANCE

(75) Inventors: John Morin, La Jolla, CA (US); Edward Mendoza, San Diego, CA (US); Noah DeLaCruz, Pacific Beach, CA (US); Andrew J. Curtis, Carlsbad, CA (US); Charles E. Golden, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 368 days.

(21) Appl. No.: 12/880,612

(22) Filed: Sep. 13, 2010

(65) Prior Publication Data

US 2012/0064995 A1 Mar. 15, 2012

(51) Int. Cl.
*A63B 53/04* (2006.01)

(52) U.S. Cl.
USPC ..... 473/329; 473/342; 473/349; 473/350

(58) Field of Classification Search
USPC ..... 473/287–292, 324–350
See application file for complete search history.

(56) References Cited

U.S. PATENT DOCUMENTS

| | | | | | |
|---|---|---|---|---|---|
| 2,846,288 | A | | 8/1958 | Fryklund | |
| 4,147,349 | A | | 4/1979 | Jeghers | |
| 4,792,140 | A | * | 12/1988 | Yamaguchi et al. | 473/331 |
| 4,928,972 | A | | 5/1990 | Nakanishi et al. | |
| 5,176,384 | A | * | 1/1993 | Sata et al. | 473/329 |
| 5,255,918 | A | * | 10/1993 | Anderson et al. | 473/330 |
| 5,346,213 | A | * | 9/1994 | Yamada | 473/329 |
| 5,403,007 | A | * | 4/1995 | Chen | 473/342 |
| 5,447,311 | A | * | 9/1995 | Viollaz et al. | 473/342 |
| 5,728,010 | A | * | 3/1998 | Hsu | 473/324 |
| 5,827,131 | A | * | 10/1998 | Mahaffey et al. | 473/342 |
| 5,863,261 | A | | 1/1999 | Eggiman | |
| 5,967,903 | A | | 10/1999 | Cheng | |
| 6,046,456 | A | | 4/2000 | Bills | |
| 6,080,068 | A | * | 6/2000 | Takeda | 473/305 |
| 6,638,183 | B2 | * | 10/2003 | Takeda | 473/335 |
| 6,743,117 | B2 | * | 6/2004 | Gilbert | 473/332 |
| 6,769,998 | B2 | * | 8/2004 | Clausen et al. | 473/342 |
| 6,857,973 | B2 | * | 2/2005 | Wieland et al. | 473/342 |
| 6,872,153 | B2 | | 3/2005 | Gilbert et al. | |
| 6,875,124 | B2 | | 4/2005 | Gilbert et al. | |
| 7,022,031 | B2 | * | 4/2006 | Nishio | 473/342 |
| 7,258,629 | B2 | * | 8/2007 | Chen | 473/342 |
| 7,491,136 | B2 | | 2/2009 | Deng et al. | |
| 7,749,096 | B2 | | 7/2010 | Gibbs et al. | |
| 2001/0055996 | A1 | | 12/2001 | Iwata et al. | |
| 2004/0157677 | A1 | * | 8/2004 | Roach et al. | 473/290 |
| 2006/0234806 | A1 | | 10/2006 | Gilbert et al. | |
| 2007/0287554 | A1 | | 12/2007 | Gilbert et al. | |
| 2009/0149277 | A1 | | 6/2009 | Deng et al. | |
| 2010/0273570 | A1 | * | 10/2010 | Ines et al. | 473/342 |

* cited by examiner

*Primary Examiner* — Sebastiano Passaniti
(74) *Attorney, Agent, or Firm* — Randy K. Chang

(57) ABSTRACT

An iron type golf club head with improved performance is disclosed herein. More specifically, the present invention discloses an iron type golf club head having a frontal face portion made out of a lightweight material that is separate and distinct from the material used to form the remaining body portion of the iron type golf club head. The thinner material allows the frontal face portion of the iron type golf club head to be made thinner, yielding improved performance characteristics such as a higher Coefficient of Restitution (COR) of greater than about 0.770, a lower Center of Gravity (CG) location of less than about 5.0 mm from a ground, and a lower primary resonant frequency of less than about 5,000 Hertz.

22 Claims, 10 Drawing Sheets

IRON GOLF CLUB HEAD WITH IMPROVED PERFORMANCE

FIELD OF THE INVENTION

The present invention relates generally to an iron type golf club head capable of achieving improved performance. More specifically, the present invention relates to an iron type golf club head that has a frontal face portion made out of a light-weight material that is separate and distinct from the material used to form the remaining body portion of the golf club head; allowing weight to be removed from the frontal face portion of the golf club head. The thinner frontal face portion may generally be less than about 3.5 mm in thickness, allowing the Coefficient of Restitution (COR) of the golf club head to be greater than about 0.770, while the weight removed from the frontal face portion may be used to shift the low Center of Gravity (CG) of the golf club head to be lower than about 5.0 mm from the ground; all while keeping a primary resonant frequency of vibration on the striking face to be less than about 5,000 Hertz.

BACKGROUND OF THE INVENTION

Because iron type golf clubs constitute a majority of the golf clubs within a golfer's club allotment, improving the performance characteristics of a set of irons may significantly help a golfer to perform better on a golf course. However, due to the inherent limitation of the keeping to the traditional size and shape of an iron type golf club, the design space available for improvements in iron type golf clubs can be limiting. Hence, due to the numerous hurdles that will be encountered in attempting to improve the performance of an iron type golf club head, golf club designers have constantly struggled with even incremental improvements to the performance of these iron type golf clubs.

One of the earlier attempts to improve the performance of an iron type golf club can be seen in U.S. Pat. No. 2,846,228 to Reach; wherein a cavity is created within the rear portion of the iron golf club head to provide more perimeter weighting. Perimeter weighting improves the performance of a golf club head by providing more forgiveness through minimizing twisting of the golf club during off-center hits, resulting in straighter and more accurate golf shots.

U.S. Pat. No. 4,147,349 to Jeghers shows another early attempt to improve the performance of an iron type golf club head by lowering the Center of Gravity (CG) of the iron type golf club head while maintaining the height of the iron type golf club head. Having a golf club head with a lower CG improves the performance of the golf club head by ensuring the CG location is always lower than the impact point between a golf club and a golf ball, resulting in greater distance and accuracy.

In general, to increase performance of the iron type golf club head, the CG of these iron type golf clubs are moved lower and further back of the club head. This permits the average golfer to get the ball up in the air faster and hit the ball further. Another way to improve the performance of an iron type golf club head is to increase the Moment Of Inertia (MOI) of the club head which minimizes the distance and accuracy penalties associated with off-center hits. In order to achieve a golf club with a lower CG and a higher MOI, material or mass needs to be taken from one area of the club head where it is not maximized. This material or mass that is removed can then be relocated to alternative locations such as the rear extremities that improves the CG and MOI. One of the earlier solutions to shift weight from non-optimal placement onto a more preferred location has been to take material from the face of the club, and moving that weight to the body of the golf club head. Examples of this type of arrangement is well known in the art, and can be found in U.S. Pat. No. 4,928,972 to Nakanishi et al., U.S. Pat. No. 5,967,903 to Cheng, and U.S. Pat. No. 6,045,456 to Best et al.

In addition to the above methodologies to improve the performance characteristics of an iron type golf club head, a fairly recent development in the golf club industry is to improve the COR of the golf club head. U.S. Patent Publication No. 2001/0055996 to Iwata et al. illustrates this concept by disclosing a golf club head having a front-part component with a rear-part component wherein each of the components have a cavity to create a hollow chamber within the body of the iron-type golf club head. This hollow chamber will generally create a golf club head with a higher coefficient of restitution in the range of at least 0.81 and not more than 0.95.

Hence, as it can be seen from above, despite all the advancement in golf club technology, the current art has been unable to effectively utilize the advantages of all of the performance enhancements mentioned above in an effective manner. More specifically, the current art has been unable to create an iron-type golf club head that has a lower CG location in combination with having a high COR. Creating a high performance iron-type golf club head that has a higher COR in combination with a lower CG greatly increases the ball-speed as well as the level of forgiveness of the golf club head, which are all desirable characteristics of an iron type golf club. Ultimately, it can be seen from above that there is a need in the art for an iron type golf club head that can combine all of the performance gains that were only individually achievable in the prior art to create an iron type golf club head that not only has a high COR, but also have a lowered CG location.

BRIEF SUMMARY OF THE INVENTION

One aspect of the present invention is a golf club head comprising of a frontal face portion, made out of a first material having a first density, connected to a forward portion of the golf club head and a body portion, made out of a second material having a second density, connected to a rear portion of the frontal face portion providing a structural for the frontal face portion. The first material used to form the frontal face portion of the present invention is different from the second material used to form the body portion of the present invention and the first density is lower than the second density. Finally, the golf club head has a face replacement ratio of greater than about 0.9 and less than about 1.0, wherein the face replacement ratio is calculated by dividing a cross-sectional height of the frontal face portion by a total cross-sectional height of a striking surface of the golf club head.

Another aspect of the present invention is a golf club head comprising of a frontal face portion, made out of a first material having a first density, connected to a forward portion of the golf club head and a body portion, made out of a second material having a second density, connected to a rear portion of the frontal face portion providing a structural for the frontal face portion. The first material used to form the frontal face portion of the present invention is different from the second material used to form the body portion of the present invention and the first density is lower than the second density. Finally, the golf club head has a velocity factor of less than about 32,500 m/x, wherein the velocity factor is determined by multiplying a CG height from ground with a primary resonant frequency, all divided by a COR of the golf club head.

A further aspect of the present invention is a golf club head comprising of a frontal face portion, made out of a first material having a first density, connected to a forward portion of the golf club head and a body portion, made out of a second material having a second density, connected to a rear portion of the frontal face portion providing a structural for the frontal face portion. The first material used to form the frontal face portion of the present invention is different from the second material used to form the body portion of the present invention and the first density is lower than the second density. Finally, the golf club head has a COR of greater than about 0.770, a CG height from ground of less than about 5.0, a primary resonant frequency of less than about 5,000 Hertz, and a thickness of the frontal face portion of less than about 3.5 mm.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
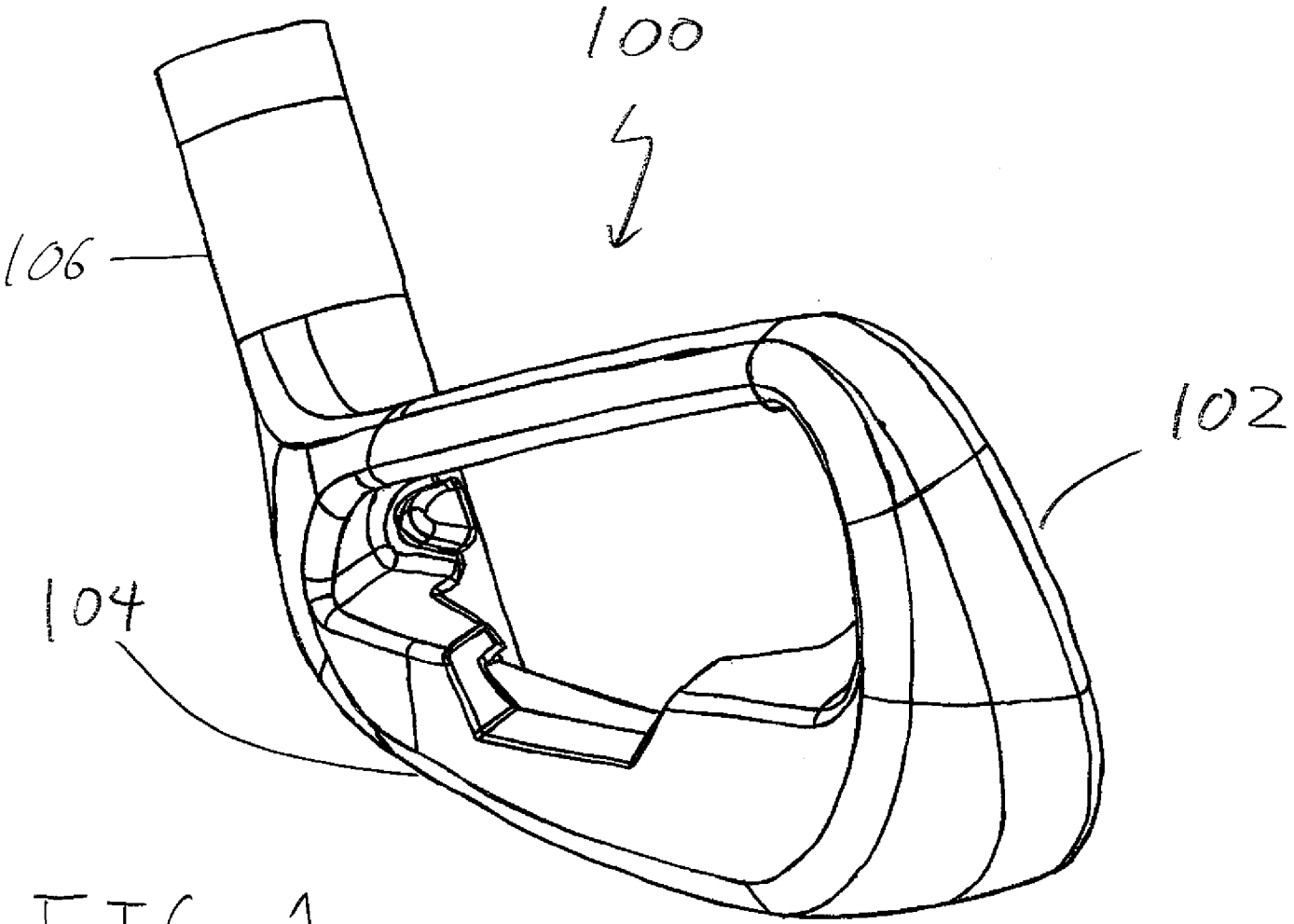
FIG. 1 shows a perspective view of a golf club head in accordance with an exemplary embodiment of the present invention.

FIG. 1 of the accompanying drawings shows a perspective view of a golf club head 100 in accordance with an exemplary embodiment of the present invention. More specifically, FIG. 1 shows a golf club head 100 with a frontal face portion 102 located near the front of the golf club head 100 for striking a golf ball. Connecting to an aft portion of the frontal face portion 102 is the body portion 104 of the golf club head 100 for providing structural support to the frontal face portion 102. The body portion 104, as shown in this exemplary embodiment of the present invention, may generally include a hosel 106 connected at the heel side of the golf club head 100 without departing from the scope and content of the present invention.

It is worth noting here that the frontal face portion 102 of this exemplary golf club head 100 may generally be formed from a first material having a first density that is different from a second material having a second density used to form the remainder of the body portion 104 of the golf club head 100. Having the frontal face portion 102 made out of a first material that is different from the second material used to form the remainder of the body portion 104 allows the golf club head 100 to have different material properties for different regions of the golf club head 100 that has different requirements. For example, the frontal face portion 102 may generally be the area of the golf club head 100 that constantly impacts a golf ball, requiring it to be stronger and more durable for impact, while the body portion 104 is not subjected to such a strong impact forces does not require such strength and durability but benefits from materials that can help manipulate the CG location. In one exemplary embodiment of the present invention, the frontal face portion 102 may be constructed out of a lightweight material that also has high strength characteristics in order to remove unnecessary weight from an undesirable location while maintaining enough strength and durability to the impact forces with a golf ball. The material used for the frontal face portion 102, as discussed in this current exemplary embodiment, may generally be formed from maraging steel due to it's high strength and low density characteristics, however, numerous other lightweight material such as 431 grade stainless steel, 1704 precipitation hardened steel, S25C carbon steel, ST-22 stainless steel, 1770 spring steel, or any other material that is capable of having lightweight and high strength characteristics may all be used without departing from the scope and content of the present invention.

Figure 2:
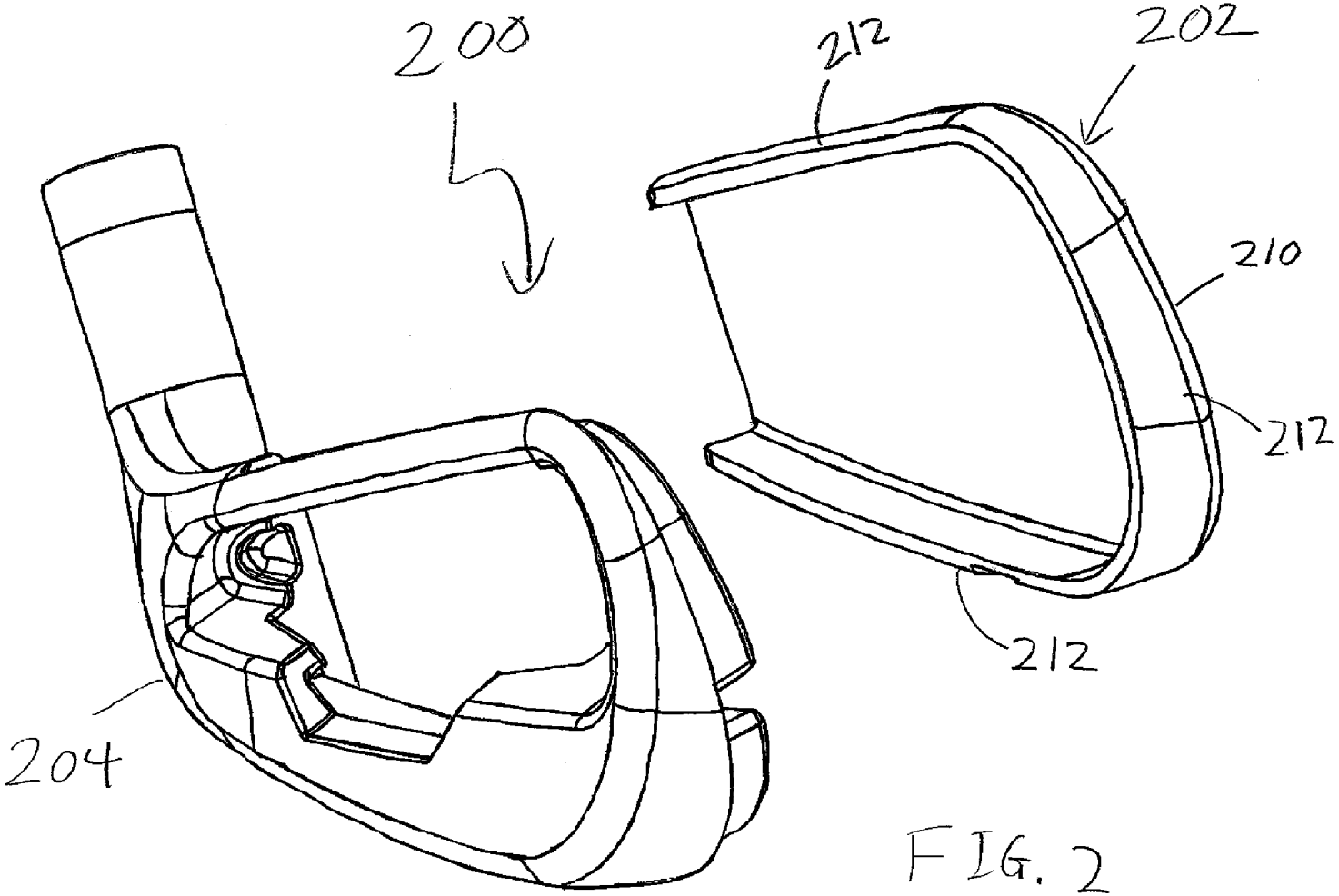
FIG. 2 shows an exploded perspective view of a golf club head in accordance with an exemplary embodiment of the present invention.

FIG. 2 of the accompanying drawings, showing an exploded prospective view of a golf club head 200 in accordance with an exemplary embodiment of the present invention, serves to demonstrate how the frontal face portion 202 and the body portion 204 interfaces with one another. It is worth noting here that the frontal face portion 202 is in the shape of a face cup in order to maximize the amount of lightweight high strength secondary material at the striking face. More specifically, the face cup may generally be comprised of a striking face 210 as well as perpendicular edge areas 212 around the top, bottom, and toe portion of the frontal face portion 202. Having such a construction is beneficial to the performance of the golf club head 200 because it allows the entire frontal face portion 202 to be constructed out of a different material than the body portion 204 of the golf club head 200. When the frontal face portion 202 is constructed out of lightweight and high strength materials, a significant amount of weight may be removed from the frontal face portion 202 and shifted to alternative locations within the body portion 204 of the golf club head to move the CG locations lower and further back to improve the performance of the golf club head 200.

Another benefit of constructing the frontal face portion 202 out of a lightweight high strength material is the ability to make the frontal face portion 202 thinner than what is traditionally possible. Having the frontal face portion 202 of the golf club head 200 thinner is beneficial to the performance of the golf club head 200 in allowing the frontal striking surface 210 to flex more, resulting in a higher COR. COR, as understood in the golf industry, relates to a unit-less fractional value that represents the ratio of the velocities before and after the golf ball impacts a golf club. Hence, it is generally desirable to have a golf club head having a higher COR, as a higher COR generally equates to the ability to hit a golf ball further. Due to the improved construction shown in FIG. 2, the golf club head 200 in accordance with this exemplary embodiment of the present invention may generally be capable of achieving a COR of greater than about 0.770, more preferably greater than about 0.773, and most preferably greater than about 0.775.

Figure 3:
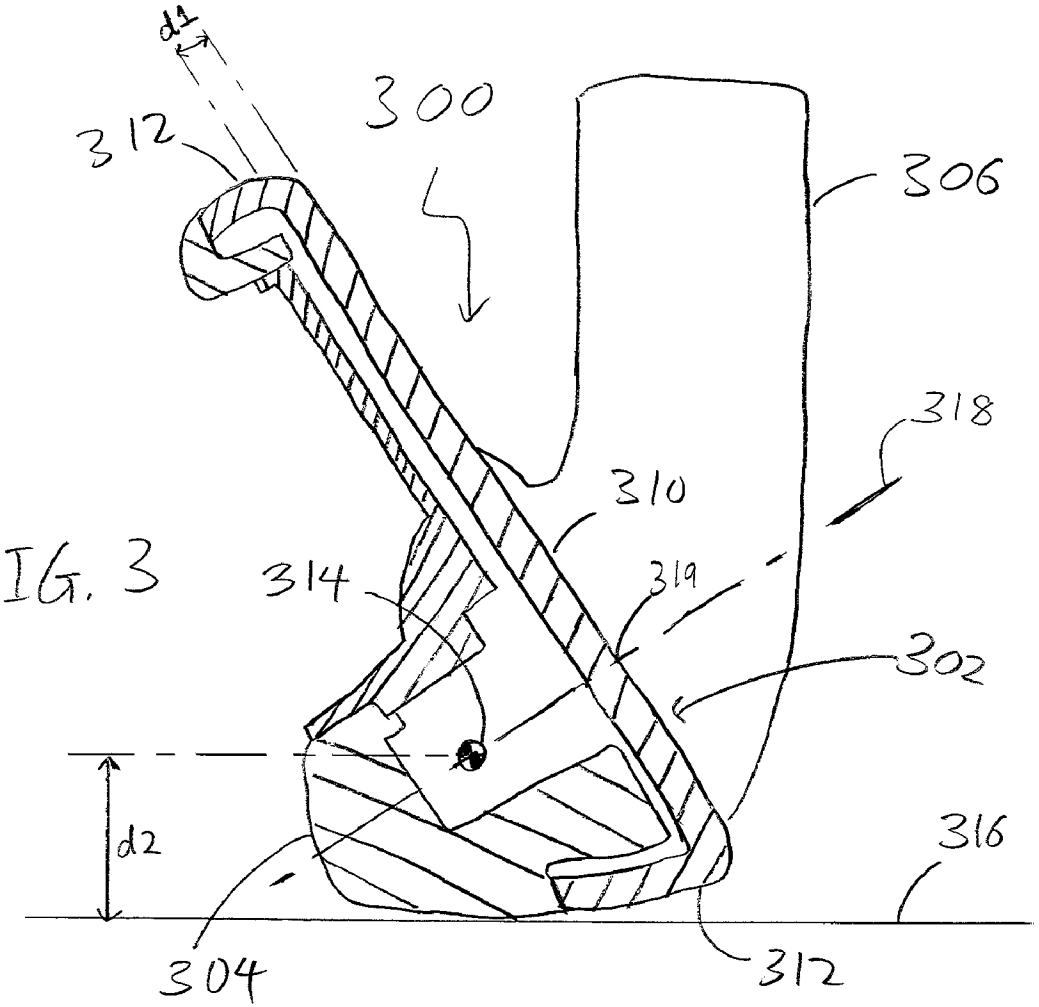
FIG. 3 shows a cross-sectional view of a golf club head in accordance with an exemplary embodiment of the present invention.

FIG. 3 of the accompanying drawings shows a cross-sectional view of the current inventive golf club head 300 taken across the middle of the golf club head 300 to show, amongst other things, the thinner striking face 310 that can be achieved by the current invention. Thickness d1 of the striking face 310 shown in FIG. 3 may help illustrate just how thin the frontal face portion 302 may be, as the COR gains of the golf club head 300 may be directly related to the thickness d1 of the striking face 310. Thickness d1, as shown in the current exemplary embodiment, may generally be less than about 3.5 mm, more preferably less than about 3.0 mm, and most preferably less than about 2.5 mm. Additionally, because the perpendicular edge areas 312 are constructed out of the same material as the striking face 310, they may generally have this reduced thickness d1 without departing from the scope and content of the present invention.

In addition to showing the thickness d1 of the striking face 310, FIG. 3 also shows the golf club head 300 with a lowered CG 314 location at a distance d2 away from the ground 316. As previously discussed, substituting the frontal face portion 302 of the golf club head 300 with a lightweight high strength material allows significant weight to be removed from the frontal face portion 302. The weight that is removed from the frontal face portion 302 may be shifted to an alternative location at the rear of the golf club head 300, shifting the CG 314 location lower than what is traditionally achievable. More specifically, the CG 314 location may be at a distance d2 of less than about 5.0 mm away from the ground 316, more preferably less than about 4.0 mm away from the ground 316, and most preferably less than about 3.0 mm away from the ground 316. This lowered CG 314 improves the performance of a golf club head by making the golf club head 300 more forgiving while increasing the COR of the golf club head 300 across a greater area of the striking face 310.

Finally, FIG. 3 also shows an impact axis 318 of the golf club head 300 in accordance with an exemplary embodiment of the present invention. Impact axis 318 may generally be defined as an imaginary axis that is perpendicular to the striking face 310 while passing through the CG 314 of the golf club head 300. This impact axis 318 is important to the performance of the golf club head 300 because it helps identify an ideal impact location 319. The ideal impact location 319 may generally be the location on the striking face 310 that yields the highest ball speed and carry distance as it creates the most efficient energy transfer between a golf club head and a golf ball.

Figure 4:
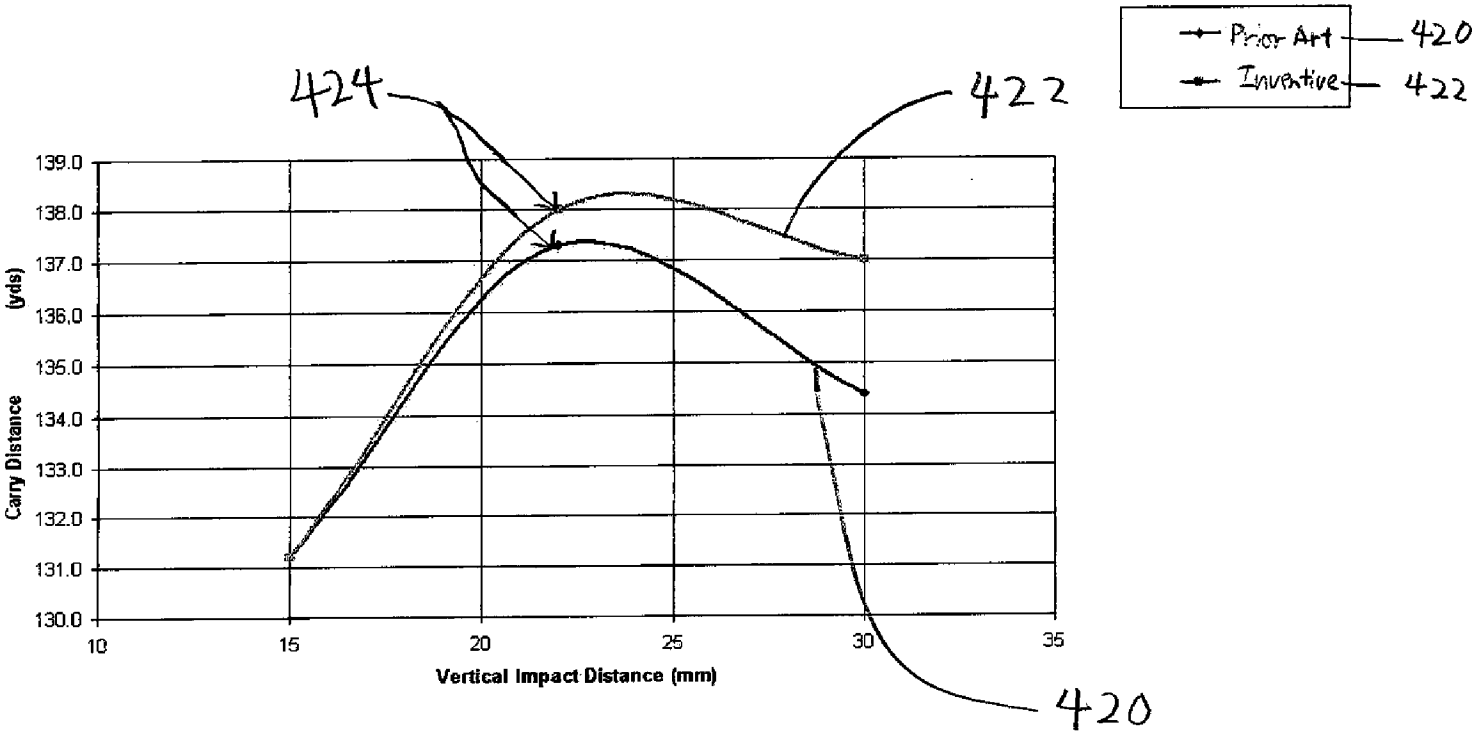
FIG. 4 shows a graphical depiction characterizing the improved performance of a golf club head in accordance with an exemplary embodiment of the present invention.

FIG. 4 of the accompanying drawings shows a graphical depiction of the improved performance achievable by the current inventive golf club head by creating a relationship between the vertical impact distance between a golf club and a golf ball on the x-axis along with the total carry distance on the y-axis. More specifically, FIG. 4 of the accompanying drawings also shows how both the lowered CG and the increased COR of the current inventive golf club head directly improves the carry distance of a golf ball struck by the inventive golf club head. Looking at FIG. 4, it can be seen that the trend line 422 of the carry distance for the inventive golf club head is noticeably higher than the trend line 420 of the carry distance of the prior art golf club head. This improvement in the carry distance in the current inventive golf club head, although more dramatic when the vertical impact distance is higher, is noticeable throughout the entire range of vertical impact distance from about 15 mm above ground to about 30 mm above ground.

It is worth noting here that although the exact source of the improvement in carry distance of the current inventive golf club head isn't blatantly obvious, it is clear that both the lowered CG location as well as the increase in COR helps the current inventive golf club head achieve a greater carry distance.

In order to try and determine the source of the carry distance improvement, an initial discussion is required on the peak carry distance point 424. Peak carry distance point 424 may generally resemble the ideal impact location 319 (shown in FIG. 3) that is formed along the impact axis 318 (shown in FIG. 3), which maximizes the energy transfer between a golf club head and a golf ball. In this exemplary embodiment of the present invention, peak carry distance point 424 may generally be at a vertical impact distance of between about 21-24 mm above the ground, more preferably between about 22-23 mm, and most preferably about 22.5 mm without departing from the scope and content of the present invention. This peak carry distance point 424 may generally serve as a vague bifurcation point between the performance improvements stemming from a lowered CG location and a higher COR.

More specifically, the lowered CG location may generally be responsible for the improvements in carry distance at vertical impact locations that are below the peak carry distance point 424; while the improved COR may generally be responsible for the improvement in carry distance at vertical impact locations that are above the peak carry distance point 424. The carry distance improvements at locations that are below the peak carry distance point 424 may be attributed to the new lowered CG location because of its proximity to the impact axis 318 (shown in FIG. 3). The carry distance improvements at locations that are above the peak carry distance point 424 may be attributed to the improved COR because the ability of the golf club face to flex greatly improves the performance of the golf club head as it moves further and further away from the impact axis 318 (shown in FIG. 3).

Figure 5:
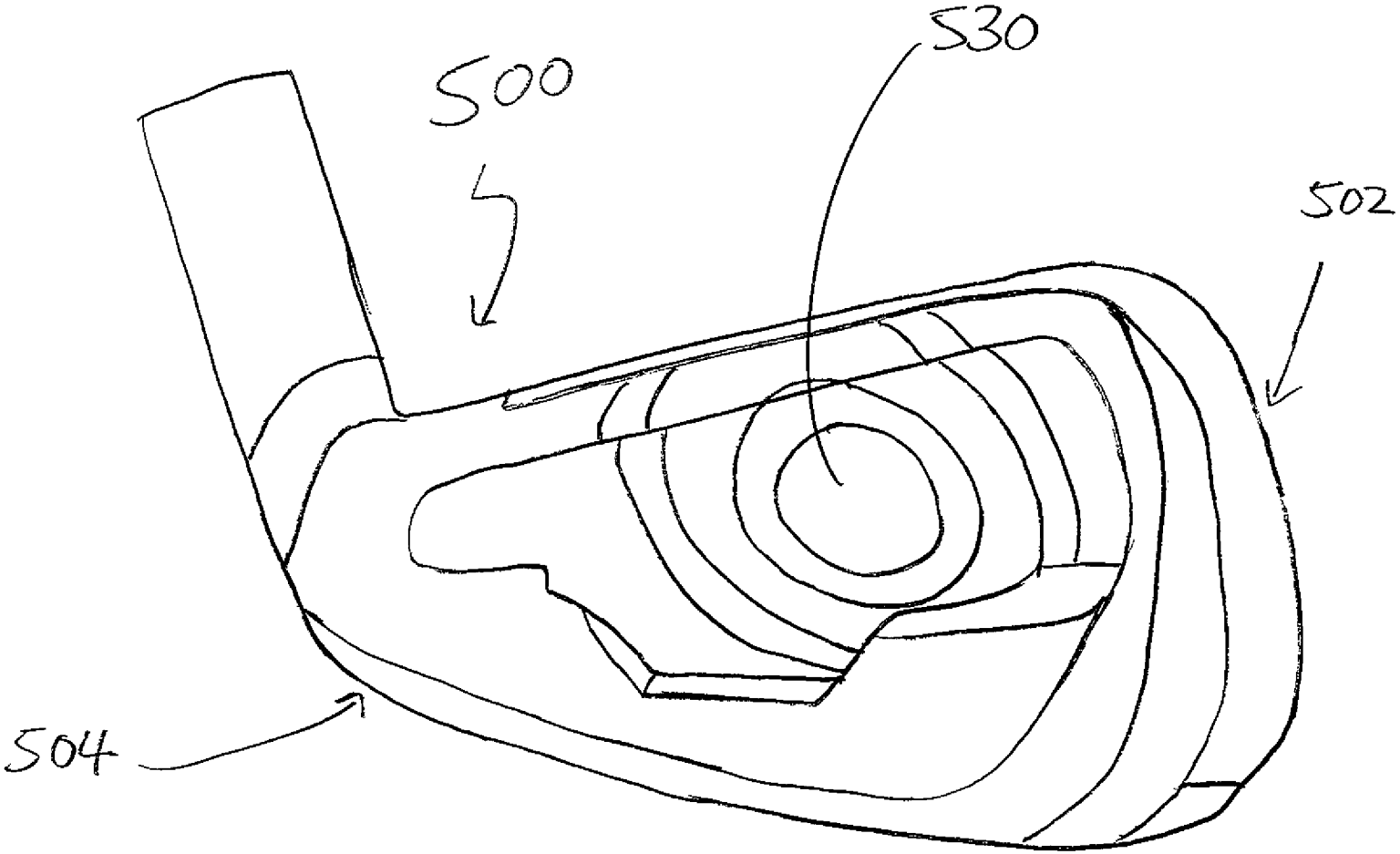
FIG. 5 shows a graphical representation of the vibration frequencies of a golf club head in accordance with an exemplary embodiment of the present invention.

FIG. 5 of the accompanying drawings shows a graphical representation of the vibration frequencies of an iron type golf club head 500 in accordance with an exemplary embodiment of the present invention. More specifically, FIG. 5 shows the vibration frequencies located on the frontal face portion 502 while having a maximum primary resonant frequency of vibration of less than about 5,000 Hertz, more preferably less than about 4,500 Hertz, and most preferably less than about 4,300 Hertz as it impacts a golf ball. This frequency may generally be captured by an audio recorder at a distance of 39 inches away from the impact source. Audio recorders such as the TASCAM® DH-P2 Portable High-Definition Stereo Audio Recorder may generally be used with an A-weighting microphone at the previously disclosed 39 inches to obtain the audio recording of a golf club impacting a golf ball to yield the frequency ranges above, however, other types of audio recorders may be used without departing from the scope and content of the present invention so long as it is capable of capturing the sound of impact between a golf club and a golf ball.

Finally, it is also worth noting in FIG. 5 that the maximum first mode frequency of the entire golf club head 500 occurs on the frontal face portion 502, which isn't always the case with prior art golf club head. Having the maximum first mode frequency of the entire golf club head 500 occurring on the frontal face portion 502 improves the performance of the golf club head because it indicates maximum deflection occurring on the frontal face portion 502, equating to greater ball speed.

Based on the performance figures discussed above, it can be seen numerous performance improvements can result from the current inventive golf club head. More specifically, performance figures such as the CG location from ground, the COR, and the primary resonant frequency of vibration are all improved when a golf club head utilizes the current inventive technology. Hence, a good way to quantify this improvement in performance can be derived based on a relationship between all of the above mentioned improvements, creating a "Velocity Factor". "Velocity Factor", as defined by the current invention, may generally be obtained by multiplying the CG height from the ground with the maximum first mode frequency of the inventive golf club head and dividing the result by the COR of the golf club head as shown below in Equation (1):

$$\text{Velocity Factor} = \frac{CG\ \text{Height from Ground} * \text{Primary Resonant Frequency}}{COR} \qquad \text{Eq. (1)}$$

The golf club head in accordance with an exemplary embodiment of the present invention may generally have a "Velocity Factor" of less than about 32,500 mm/s, more preferably less than about 24,000 mm/s, and most preferably less than about 17,000 mm/s.

Figure 6:
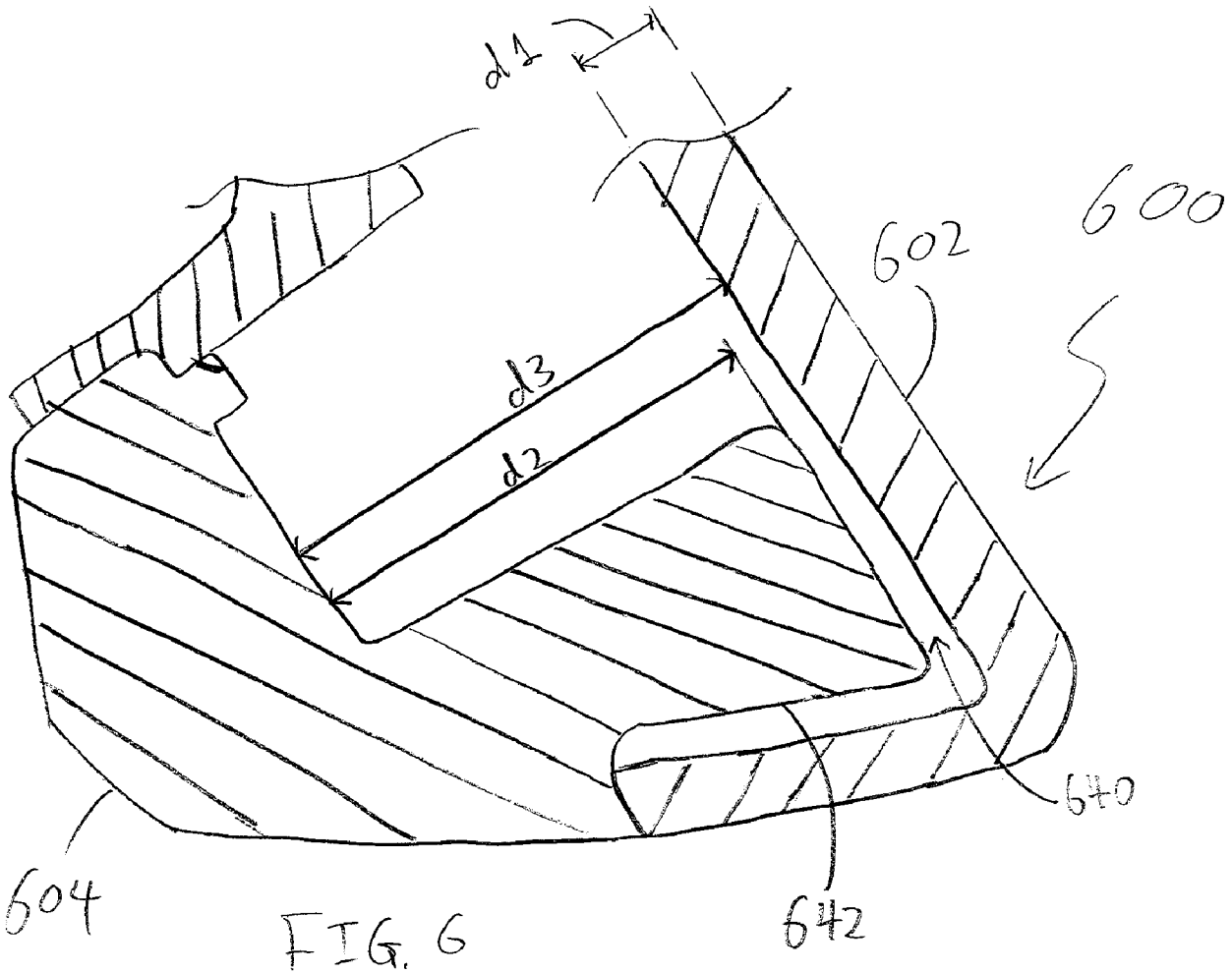
FIG. 6 shows an enlarged cross-sectional view of the sole portion of a golf club head in accordance with an exemplary embodiment of the present invention.

In addition to the "Velocity Factor", the golf club head in accordance with this exemplary embodiment of the present invention may utilize a unique geometry to further improve the performance of the golf club head. FIG. 6 showing an enlarged view of the sole portion of an inventive golf club head 600 allows a clearer view of this unique geometry used to further improve the performance of the golf club head 600. More specifically, the enlarged view of the sole portion shows a gap 640 between the frontal face portion 602 and the body portion 604 of the golf club head 600. This gap 640, created by a protrusion 642, further improves the performance of the golf club head 600 by providing a backstop to the frontal face portion 602, which in this current exemplary embodiment of the present invention, is designed thinner to allow for more deflection of the frontal face portion 602. However, because excessive deflection of the frontal face portion 602 can cause the frontal face portion 602 to break, having such a gap 640 with the protrusion 642 acting as a backstop allows the frontal face portion 604 to be designed even thinner by controlling the excessive deflection.

Before moving on to the methodology used to quantify the gap 640, it is worthwhile to define protrusion 642 within the scope of this current invention. Protrusion 642, as used within the context of this invention, may generally relate to any material formed behind the frontal face portion 602 of the golf club head that can be used to provide a backstop to prevent excessive deflection of the frontal face portion 602.

In order to quantify the depth of the gap 640, a ratio between distance d2 of the protrusion 642 and the total distance d3 towards the rear surface of the frontal face portion 602 shown below in Equation (2) may be used to create a "Support Ratio".

$$\text{Support Ratio} = \frac{\text{Distance } d2}{\text{Distance } d3} \qquad \text{Eq. (2)}$$

"Support Ratio" of a golf club head 600 in accordance with an exemplary embodiment of the present invention may generally be less than about 1.0, more preferably less than about 0.95, and most preferably less than about 0.9.

Figure 7:
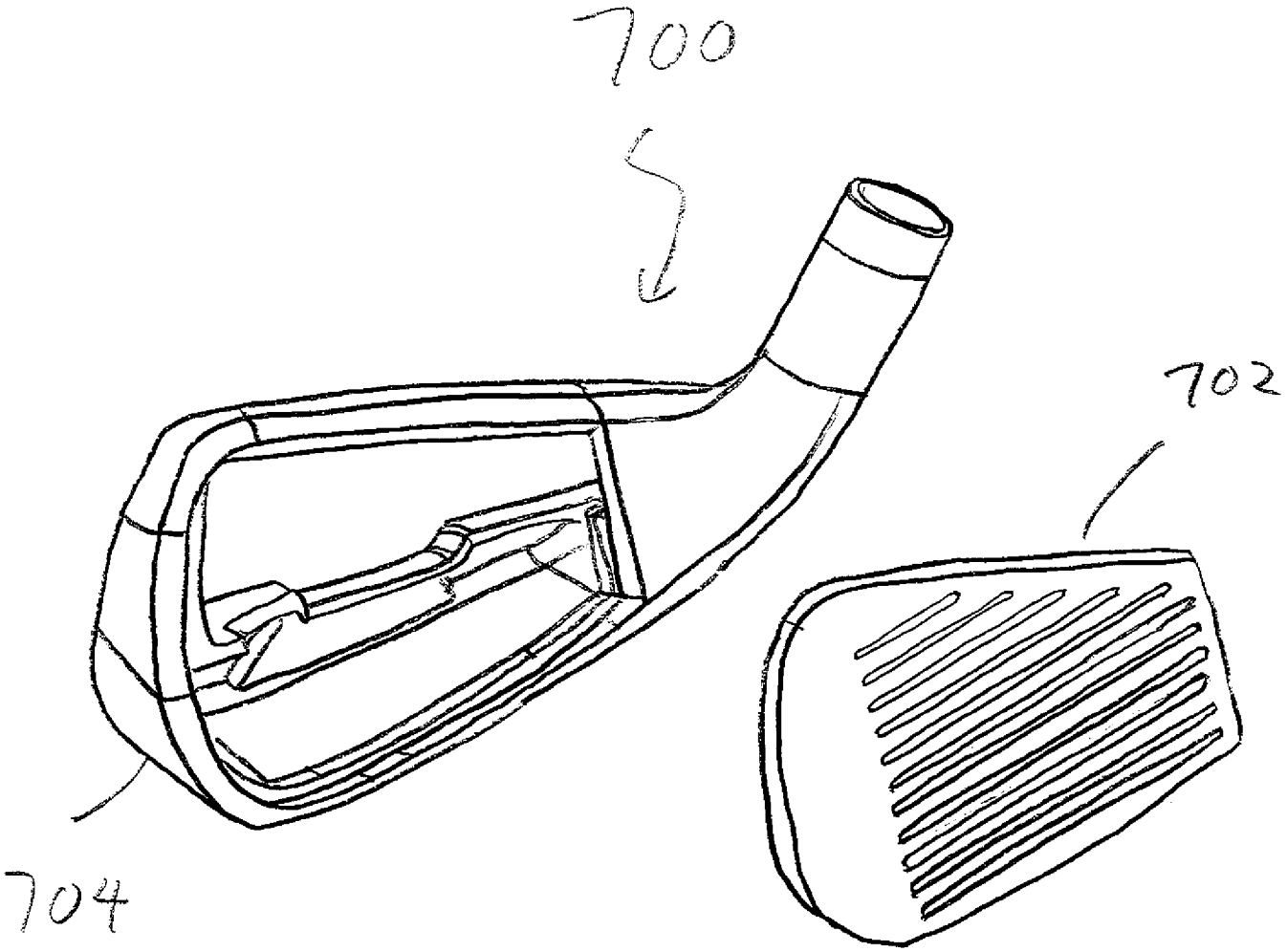
FIG. 7 shows an exploded perspective view of a golf club head in accordance with an alternative embodiment of the present invention.

FIG. 7 of the accompanying drawings shows an exploded perspective view of a golf club head 700 in accordance with an alternative embodiment of the present invention. Golf club head 700, as shown in FIG. 7, could have a frontal face portion 702 in the shape of a face insert instead of a face cup to achieve the same performance gains without departing from the scope and content of the present invention. The difference in geometry between a face insert and a face cup illustrates that the performance gains achievable by the inventive golf club head is not dependent on the specific geometry of the frontal face portion 702, but rather dependent on the ability to replace a majority of the striking surface with a different secondary material that has different material properties than the remainder of the golf club head 700.

Figure 8:
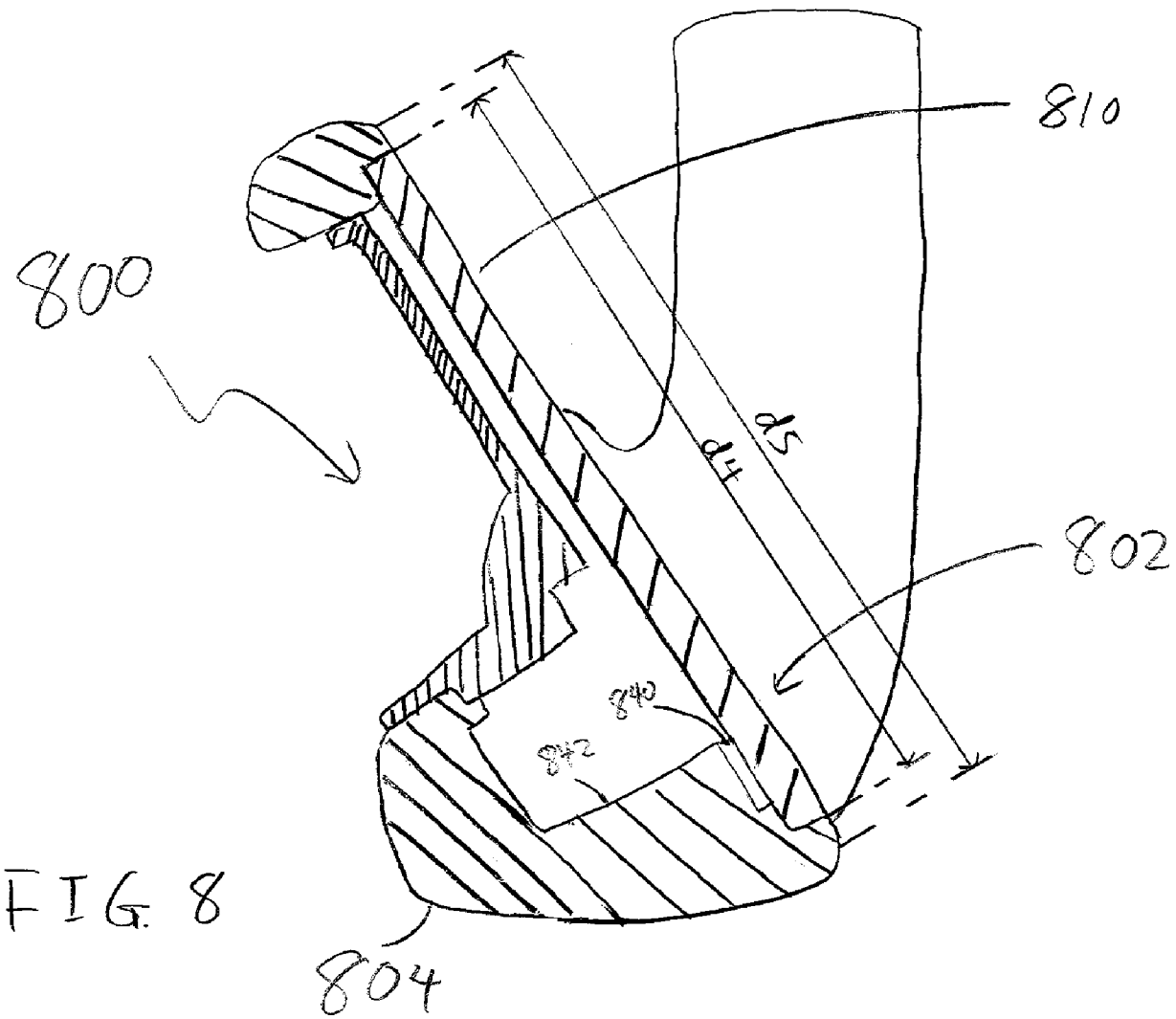
FIG. 8 shows a cross-sectional view of a golf club head in accordance with an alternative embodiment of the present invention.

FIG. 8 shows a cross-sectional view of a golf club head 800 in accordance with the alternative embodiment of the present invention shown in FIG. 7 taken down the middle of the golf club head 700. This cross-sectional view of the golf club head 800 illustrates a striking surface 810 height d5 and a frontal face portion 802 height d4, which can be used to determine the amount of the striking surface 810 that is replaced with the secondary material. In order to quantify the amount of the striking surface 810 that needs to be replaced with this secondary material, a minimum "Face Replacement Ratio" can be created based on Equation (3) shown below.

$$\text{Face Replacement Ratio} = \frac{\text{Frontal Face Portion Height } (d4)}{\text{Striking Surface Height } (d5)} \qquad \text{Eq. (5)}$$

Although the exact dimension of the relative heights d4 and d5 are not crucial to the performance gains achievable by a golf club head 800 in accordance with the present invention, the "Face Replacement Ratio" is important in ensuring that a significant amount of the striking surface 810 is replaced with this secondary material that is generally lighter and more durable. The golf club head 800 in accordance with this exemplary embodiment of the present invention may generally have a "Face Replacement Ratio" of greater than about 0.9 and less than about 1.0, more preferably greater than about 0.925 and less than about 1.0, and most preferably greater than about 0.95 and less than about 1.0. Finally, it is worth noting that the golf club head 800 utilizing a face insert shaped frontal face portion 802 may also have a gap 840 created behind the frontal face portion 802 to provide structural support to for the thinner frontal face portion 802 that deflects without departing from the scope and content of the present invention.

Figure 9:
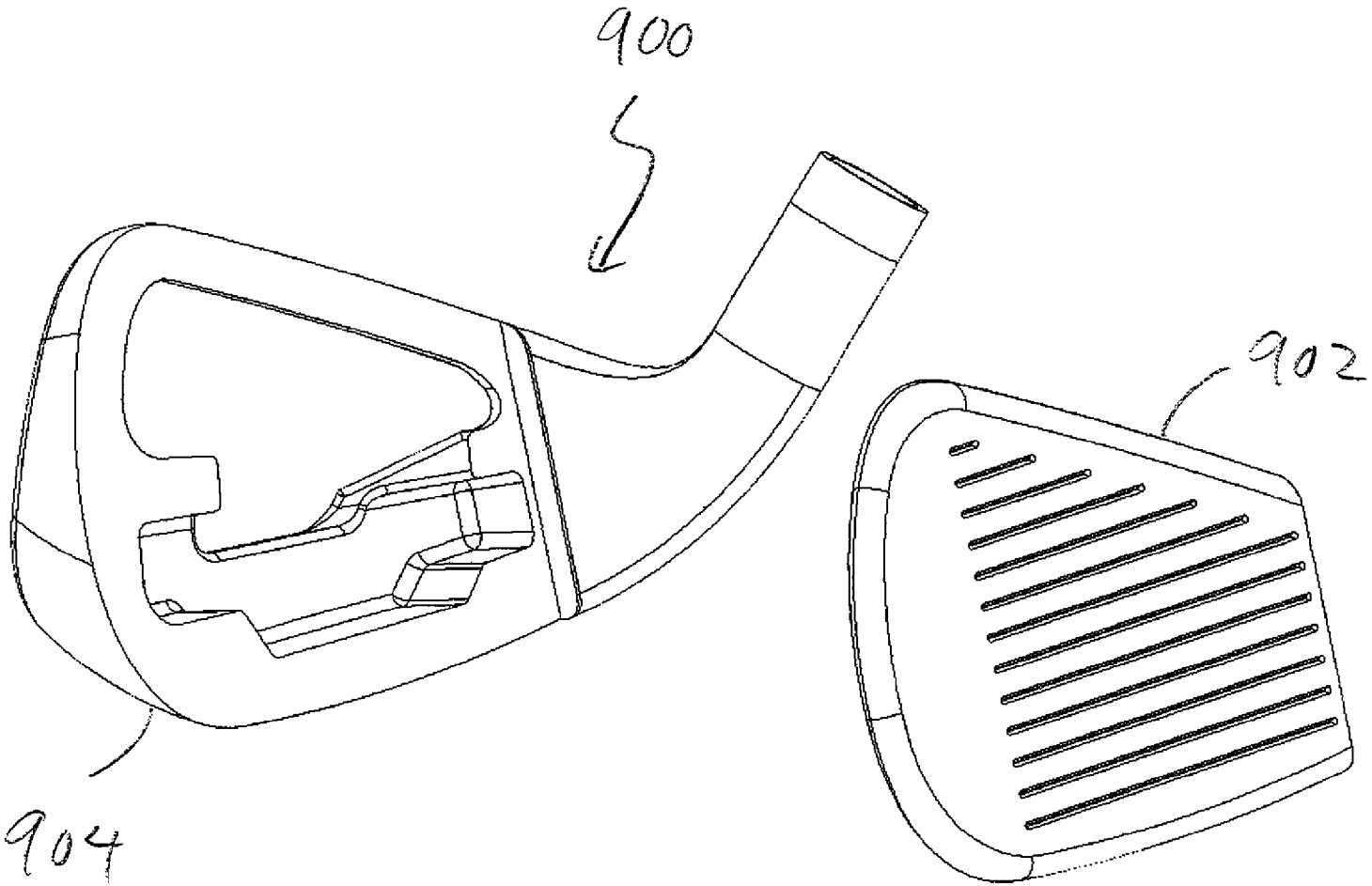
FIG. 9 shows an exploded perspective view of a golf club head in accordance with a further alternative embodiment of the present invention.

FIG. 9 of the accompanying drawings shows an exploded perspective view of a golf club head 900 in accordance with a further alternative embodiment of the present invention. Golf club head 900 may generally have a frontal face portion 902 in the shape of a plate, which is different from a face cup (shown in FIGS. 2-3) and a face insert (shown in FIGS. 7-8). Having a frontal face portion 902 in the shape of a face plate allows a greater amount of the striking surface to be replaced with this secondary material, which helps improve the performance of the golf club head 900 as discussed above. Once again, the exact shape and size of the frontal face portion 902 is not critical to achieving the improved performance numbers discussed above, so long as the frontal face portion 902 replaces a significant amount of the striking surface.

Figure 10:
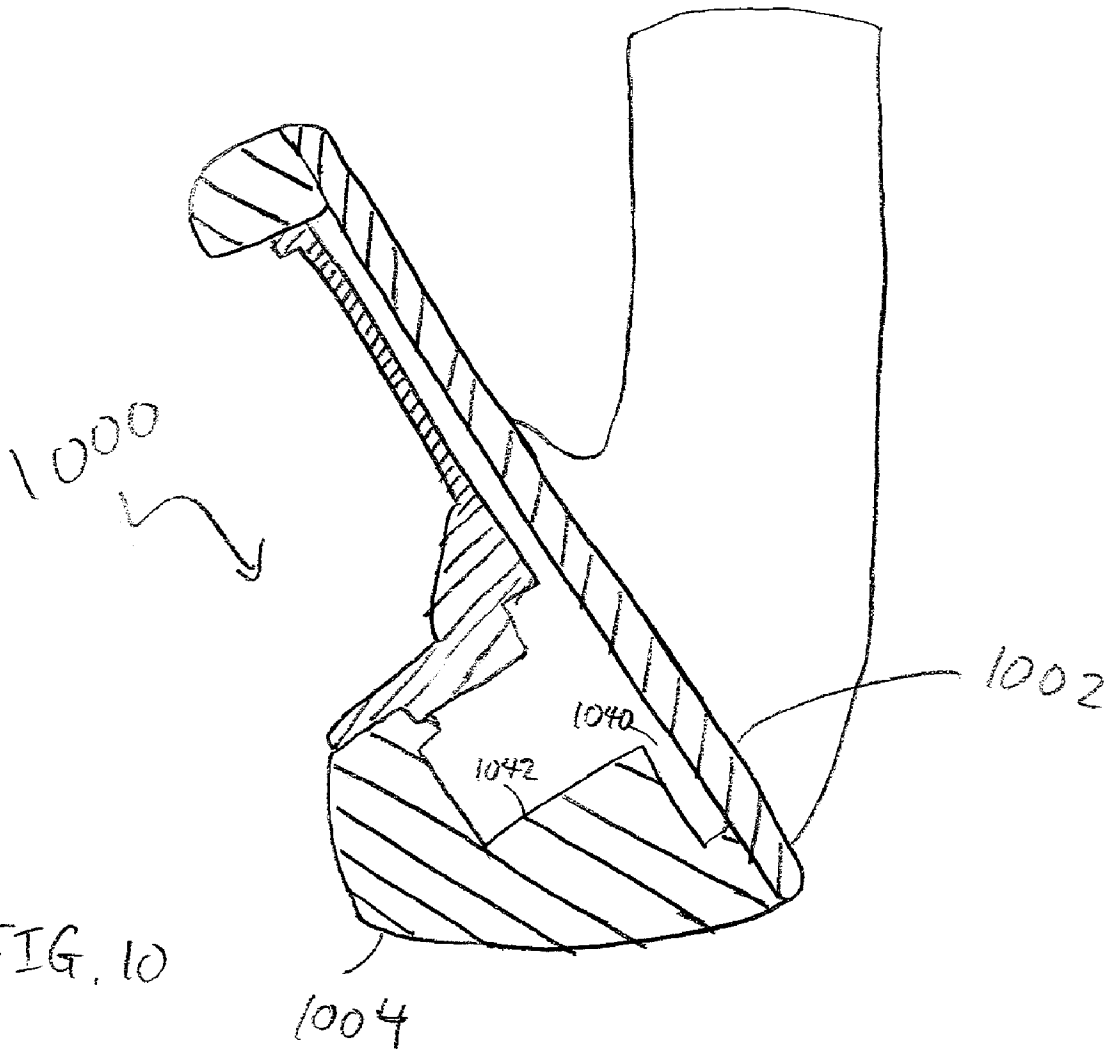
FIG. 10 shows a cross-sectional view of a golf club head in accordance with a further alternative embodiment of the present invention.

FIG. 10 of the accompanying drawings shows a cross-sectional view of a golf club head 1000 in accordance with the further alternative embodiment of the present invention shown in FIG. 9 taken across the middle of the golf club head 900. Similar to the previous discussions, it can be seen that the frontal face portion 1002 occupies a hundred percent, which is a significant portion, of the striking surface of the golf club head 1000. The body 1004 is connected to the rear of the frontal face portion 1002 yielding a gap 1040 near the sole portion of the golf club head 1000 to provide a backstop to the amount of deflection that can be achieved by the frontal face portion 1002.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. An iron type golf club head comprising:

a frontal face portion, made out of a first material having a first density, connected to a forward portion of said iron type golf club head;

a body portion, made out of a second material having a second density, connected to a rear portion of said frontal face portion providing a structural support for said frontal face portion;

wherein said first material is different from said second material;

wherein said first density is lower than said second density; and wherein said iron type golf club head has a face replacement ratio of greater than about 0.9 and less than about 1.0;

said face replacement ratio is calculated by dividing a cross-sectional height of said frontal face portion by a total cross-sectional height of a striking surface of said iron type golf club head, wherein said iron type golf club head has a velocity factor of less than about 32,500 mm/s;

said velocity factor is determined by multiplying a CG height from ground with a primary resonant frequency all divided by a COR of said iron type golf club head.

2. The iron type golf club head of claim 1, wherein said COR of said iron type golf club head is greater than about 0.770.

3. The iron type golf club head of claim 2, wherein said COR of said iron type golf club head is greater than about 0.773.

4. The iron type golf club head of claim 3, wherein said COR of said golf iron type club head is greater than about 0.775.

5. The iron type golf club head of claim 1, wherein said CG height from ground is less than about 5.0 mm.

6. The iron type golf club head of claim 5, wherein said CG height from ground is less than about 4.0 mm.

7. The iron type golf club head of claim 6, wherein said CG height from ground is less than about 3.0 mm.

8. The iron type golf club head of claim 1, wherein said primary resonant frequency of said iron type golf club head is less than about 5,000 Hertz.

9. The iron type golf club head of claim 8, wherein said primary resonant frequency of said iron type golf club head is less than about 4,500 Hertz.

10. The iron type golf club head of claim 9, wherein said primary resonant frequency of said iron type golf club head is less than about 4,300 Hertz.

11. The iron type golf club head of claim 1, wherein a thickness of said frontal face portion is less than about 3.5 mm.

12. The iron type golf club head of claim 11, wherein said thickness of said frontal face portion is less than about 3.0 mm.

13. The iron type golf club head of claim 12, wherein said thickness of said frontal face portion is less than about 2.5 mm.

14. The iron type golf club head of claim 1, wherein said first material is a maraging steel.

15. An iron type golf club head comprising:

a frontal face portion, made out of a first material having a first density, connected to a forward portion of said iron type golf club head;

a body portion, made out of a second material having a second density, connected to a rear portion of said frontal face portion providing a structural support for said frontal face portion;

wherein said first material is different from said second material;

wherein said first density is lower than said second density; and wherein said iron type golf club head has a velocity factor of less than about 32,500 mm/s;

said velocity factor is determined by multiplying a CG height from ground with a primary resonant frequency all divided by a COR of said iron type golf club head.

16. The iron type golf club head of claim 15, wherein said velocity factor is less than about 24,000 mm/s.

17. The iron type golf club head of claim 16, wherein said velocity factor is less than about 17,000 mm/s.

18. The iron type golf club head of claim 15, wherein a thickness of said frontal face portion is less than about 3.5 mm.

19. The iron type golf club head of claim 18, wherein said thickness of said frontal face portion is less than about 3.0 mm.

20. The iron type golf club head of claim 19, wherein said thickness of said frontal face portion is less than about 2.5 mm.

21. The iron type golf club head of claim 15, wherein said first material is a maraging steel.

22. An iron type golf club head comprising:

a frontal face portion, made out of a first material having a first density, connected to a forward portion of said iron type golf club head;

a body portion, made out of a second material having a second density, connected to a rear portion of said frontal face portion providing a structural support for said frontal face portion;

wherein said first material is different from said second material, wherein said first density is lower than said second density, wherein a COR of said iron type golf club head is greater than about 0.770, wherein a CG height from ground is less than about 5.0 mm, wherein a primary resonant frequency of said iron type golf club head is less than about 5,000 Hertz, and wherein a thickness of said frontal face portion is less than about 3.5 mm.

* * * * *